US005383399A

United States Patent [19]

German

[11] Patent Number: 5,383,399

[45] Date of Patent: Jan. 24, 1995

[54] ZERO HAMMER ADJUSTMENT DRUM PRINTER CONTROL TECHNIQUE

[75] Inventor: Trevor J. German, Waterloo, Canada

[73] Assignee: NCR Corporation, Dayton, Ohio

[21] Appl. No.: 127,027

[22] Filed: Sep. 27, 1993

[51] Int. Cl.[6] ..... B41T 9/36

[52] U.S. Cl. ..... 101/93.01; 101/93.14; 101/93.29; 400/146; 400/157.3

[58] Field of Search ..... 101/93.13, 93.14, 93.18, 101/93.21, 93.28, 93.29, 93.30, 93.31, 93.32, 93.33, 93.34, 93.01, 93.19, 93.20; 400/157.2, 157.3, 144, 145, 145.1, 146, 54, 74; 361/159; 371/25.1, 28

[56] References Cited

U.S. PATENT DOCUMENTS

| | | | |
|---|---|---|---|
| 3,740,615 | 6/1973 | Vigini | 101/93.29 X |
| 3,872,788 | 3/1975 | Palombo | 101/93.14 |
| 4,152,983 | 5/1979 | Toyomura et al. | 101/93.23 |
| 4,259,903 | 4/1981 | Arendt et al. | 101/93.03 |
| 4,425,844 | 1/1984 | Carrington et al. | 101/93.14 |
| 4,440,079 | 4/1984 | Dayger et al. | 101/93.03 |
| 4,597,328 | 7/1986 | Carrington et al. | 101/93.13 |
| 4,636,959 | 1/1987 | Salazar et al. | 364/464 |
| 4,706,561 | 11/1987 | Greer | 101/93.01 |
| 4,743,821 | 5/1988 | Hall | 101/93.14 X |
| 4,764,039 | 8/1988 | Bublitz | 400/146 |
| 4,821,639 | 4/1989 | Carrington et al. | 101/93.14 |

OTHER PUBLICATIONS

IBM Technical Disclosure Bulletin, vol. 34, No. 7B Dec. 1991; "Print Hammer Flight Time Compensation For Supply Voltage Variation".

IBM Technical Disclosure Bulletin, vol. 27, No. 4B Sep. 1984 "Flight Time System For a High Speed Impact Printer".

*Primary Examiner*—Edgar S. Burr
*Assistant Examiner*—Christopher A. Bennett
*Attorney, Agent, or Firm*—Elmer Wargo

[57] ABSTRACT

A method and apparatus for controlling the adjustment of printer hammers which impact against an associated moveable member on which characters are present. Each hammer includes a coil which is energized at the appropriate time, taking into consideration the "flight time" of the associated hammer. These flight times are determined by detecting a change in the back EMF in the energizing current to the coil. These flight times are averaged to obtain a running average of the last several successive flight times (for each hammer in the printer), and successive timing pulses from a timing disc are used to obtain an almost instantaneous velocity of the moveable member (like a printer drum) just prior to a character to be printed. The last several successive flight times are stored in a non-volatile RAM of a controller to enable the printer to be ready at a next start up.

9 Claims, 4 Drawing Sheets

ZERO HAMMER ADJUSTMENT DRUM PRINTER CONTROL TECHNIQUE

BACKGROUND OF THE INVENTION

1. Field of Invention

This invention relates to a method and apparatus for firing a series of print hammers associated with a moveable member, like a rotating drum, for example.

2. Background Information

FIG. 1 shows the geometry of a drum printer of the prior art. A rotating drum carrying a plurality of characters around the periphery thereof is mounted for rotation in a frame of a printer. Several hammer assemblies (extending into the plane of the drawing) are mounted in a hammer frame and are arranged to impact against a ring of characters positioned around the periphery of the drum. An ink ribbon and the document to be printed upon are positioned between the characters on the rotating drum and an associated hammer tip for each one of the hammer assemblies. Each hammer assembly includes a hammer frame, coil, backstop adjustment screw, and hammer tip which are assembled in the general arrangement shown in FIG. 1. When current is applied to the coil, the associated tip is propelled forward to strike the associated character on the rotating drum.

The time taken by the hammer tip to travel from its rest position to the strike position is termed the flight time. Usually, the printer is adjusted so that the desired hammer is fired one "flight time" ahead of the character to be printed. To accomplish this, a drum position sensor is positioned at a physical angle to lead the characters on the drum by one flight time.

The flight time for any one hammer is dependent upon several variables including:

1) Distance from the rest position to the drum.

2) Magnitude of the drive current in the associated energizing coil.

3) Magnetic field strength around the hammer being fired.

4) Strength of the return spring.

SUMMARY OF THE INVENTION

An object of this invention is to provide a method and system for compensating for the variables mentioned as affecting the flight time of the hammers so as to remove the need for adjustment and adjustment mechanisms.

Some advantages of this invention are that it is simple and inexpensive to implement.

Another advantage is that the timing disc sensor does not have to be adjusted after it has been set in a fixed position.

In a first aspect of this invention, there is provided a method in a printer having characters on a moveable member, with the moveable member being positioned to present a selected character at a printing station in the printer, and with the selected character being printed on a document through using a hammer which impacts against the document and the selected character when an associated firing coil is electrically energized, said method being for checking on whether or not the hammer impacted against the selected character comprising the steps of:

(a) energizing the coil for the hammer to be fired; and (b) monitoring the back electromotive force (EMF) of the coil as the hammer moves towards the selected character to detect whether or not the back EMF reverses direction as the result of the hammer rebounding from impacting against the selected character.

In a second aspect of this invention, there is provided in a printer, a combination comprising:

a moveable member having a plurality of characters thereon;

a transport for moving said moveable member at a constant velocity;

a hammer assembly having a hammer and a coil; and a circuit for energizing said coil to enable said hammer to impact against a selected character on said moveable member and for detecting when back electromotive force (EMF) in said coil reverses direction to give an indication that the hammer has in fact impacted against the selected character.

The above advantages and others will be more readily understood in connection with the following specification, claims, and drawing.

DETAILED DESCRIPTION OF THE PREFERRED EMBODIMENT

Figure 2:
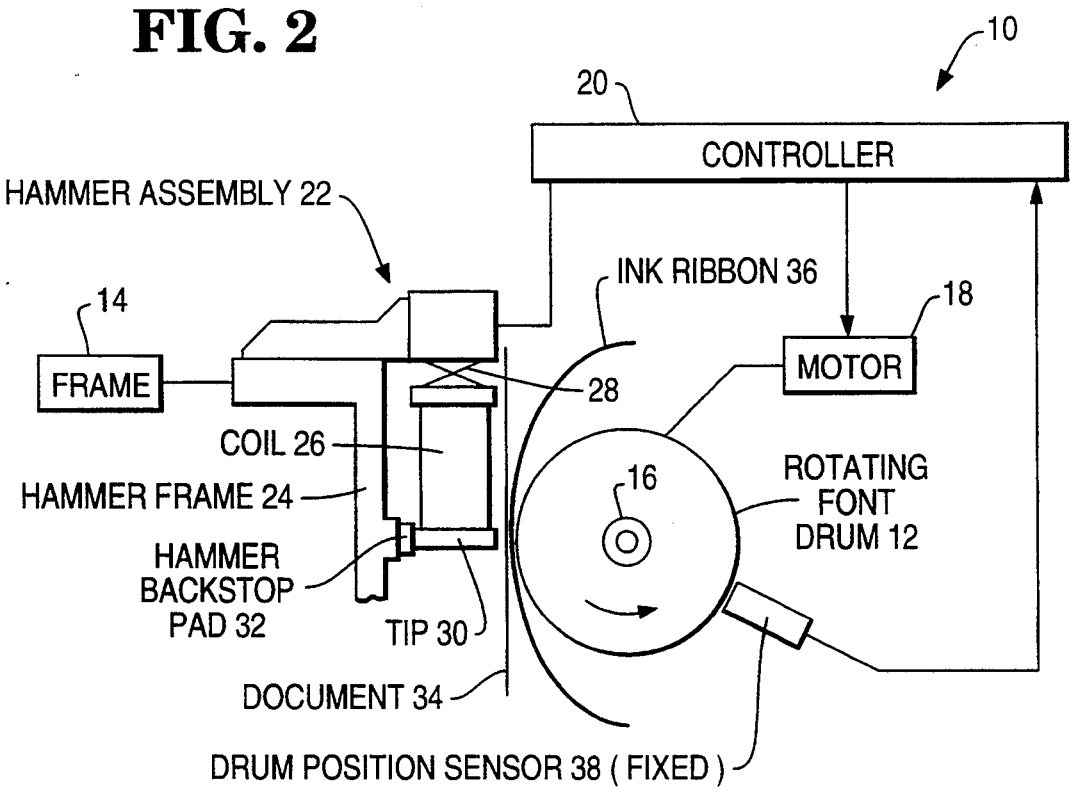
FIG. 2 is a schematic diagram showing a drum printer made according to the present invention.

FIG. 2 is a schematic diagram showing a drum printer 10 having a printer font drum (drum 12) which is rotatably mounted in a frame 14 (shown only schematically) of the printer 10. The drum 12 is rotated about an axis 16 by a motor 18 under the control of a controller 20. The axis 16 is perpendicular to the plane of FIG. 2.

The printer 10 also includes a hammer assembly 22 for each character position along the length of the drum 12. Each hammer assembly 22 is mounted in a hammer frame 24 which is secured to the frame 14. Each hammer assembly 22 also includes a coil 26 moveably mounted on a spring 28, with an associated tip 30 being secured to the coil 26 and being aligned with the associated ring of characters (FIG. 3) on the drum 12. The hammer or tip 30 rests against a hammer backstop pad 32 when the hammer assembly 22 is in an idle state. The pad 32 simply is a resilient stop which absorbs some of the rebound energy from the hammer tip 30; there is no adjustment necessary for the pad 32.

A document 34 to be printed upon and an ink ribbon 36 are positioned between the tip 30 and the rotating drum 12. A drum position sensor 38 is located at a fixed position relative to the drum 12, and it is used to provide an "edge" signal at the moment that each character on the rotating drum 12 comes into alignment with the associated print line which is aligned with the tip 30. This is a feature of this invention in that the drum position sensor 38 does not have to be offset to take into consideration the flight time of each of the hammer assemblies 22 in the printer 10.

As previously stated, there are several variables which affect the flight time of any one hammer assembly. In the embodiment described, the flight times are generally about two milliseconds, and the distance which each of the tips 30 travels to impact against the document 34, ink ribbon 36, and the drum is about 0.00001 of an inch.

Figure 3:
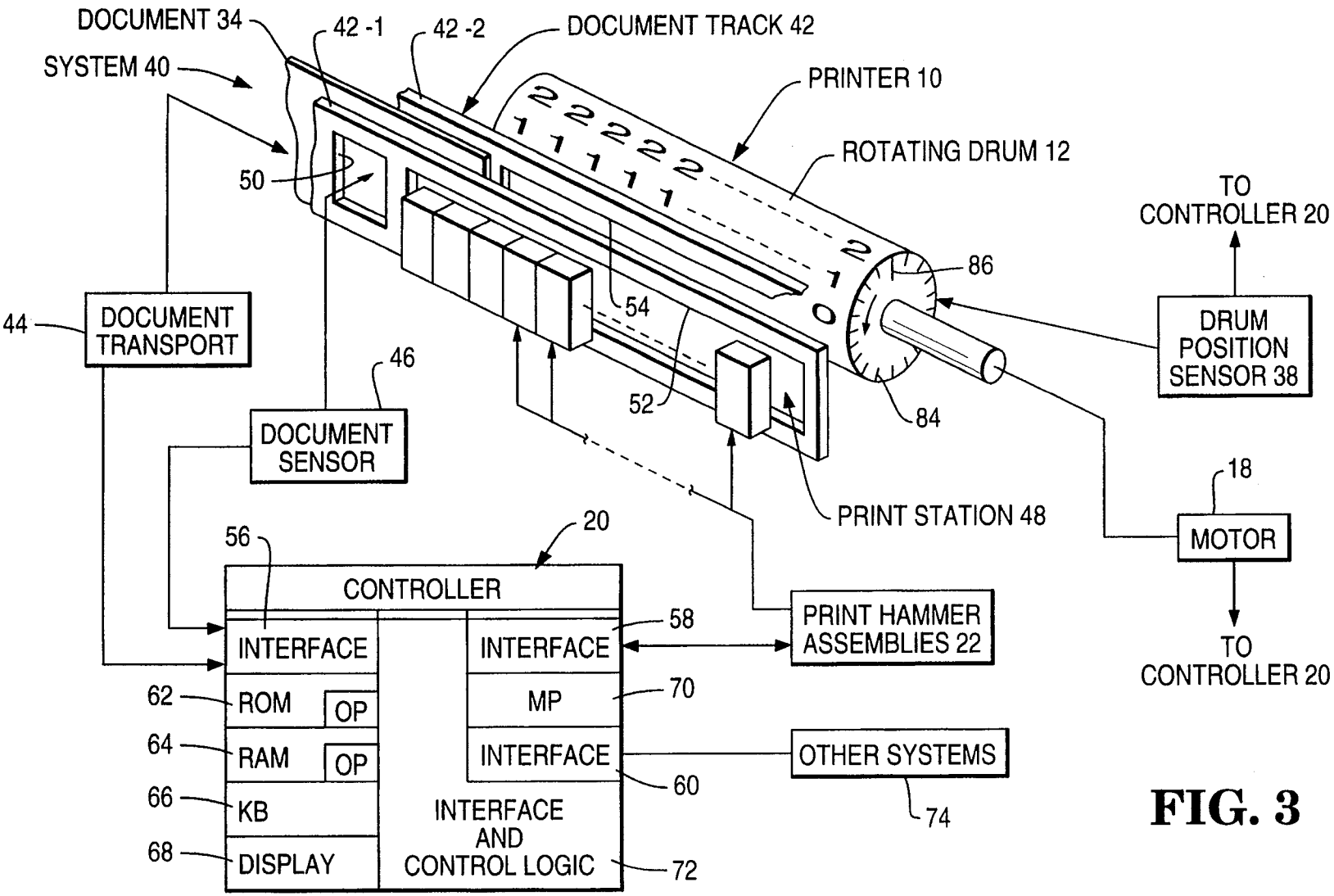
FIG. 3 is an isometric diagram showing a typical embodiment in which this invention may be used.

FIG. 3 is a schematic diagram showing several additional elements included in the printer 10. The printer 10 may be included in a larger system 40 like an encoder or other business machine (not shown). The system 40 may include a document track 42 having front and rear upstanding walls 42-1 and 42-2, respectively, between which the document 34 may be moved. The document 34 is moved by a document transport 44 which is under the control of the controller 20. A document sensor 46 is used to indicate to the controller 20 when the document 34 is positioned at a print station 48 to be in operative relationship with the printer 10 to effect printing on the document 34 as will be described hereinafter. There are suitable openings 50, 52, and 54 in the front and rear walls 42-1 and 42-2 to enable the document sensor 46 and the printer 10 to interface with the document 34.

The controller 20 is shown in schematic form to indicate the various functions performed by the controller 20 whereas the actual form of the controller 20 (which may be conventional) is different from that shown. The controller 20 includes: interfaces 56, 58, and 60; a read only memory (ROM) 62; a random access memory (RAM) 64; a keyboard (KB) 66; a display 68; a microprocessor (MP) 70; and interface and control logic 72 which is used to interface the various elements mentioned. The interface 56 is used to couple the document transport 44, the document sensor 46, and the motor 18 to the controller 20. The interface 58 couples the print hammer assemblies 22 and the drum position sensor 38 to the controller 20, and the interface 60 may be used to couple the controller 20 to other systems 74, like a host or central system. The software or operating system (OP) for controlling the operation of the printer 10 may reside in the ROM 62 or be downloaded into the RAM 64. The operating system OP will be discussed hereinafter.

Figure 4:
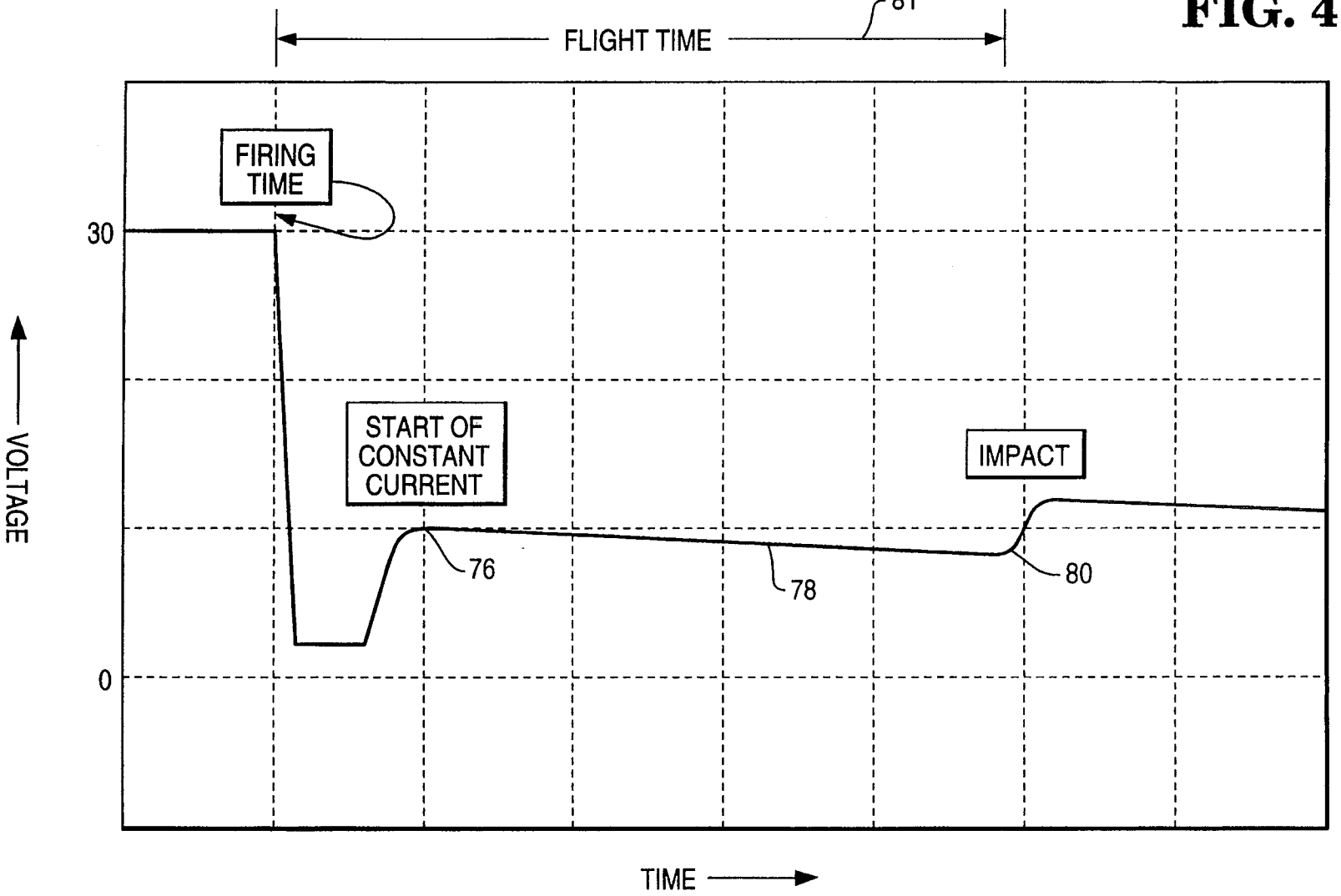
FIG. 4 is a chart showing hammer flight time determination.

A feature of the present invention is that it makes use of the back EMF generated in the coil 26 (FIG. 2) to determine the flight time of each of the hammer assemblies 22 shown in FIG. 3; FIG. 4 is useful in this regard. FIG. 4 shows the firing time or instant when the associated coil 26 in a hammer assembly 22 is energized. After firing, there is a large drop in voltage due to the inductance of the coil. As the current builds up in the coil, the current begins to stabilize at point 76 which is also marked as the Start of Constant Current. Thereafter, the current remains substantially constant (as indicated by line 78) until the hammer tip 30 impacts against the drum 12 to effect printing. The point of impact is shown at 80 where the back EMF in the coil 26 changes direction as the hammer tip 30 changes direction to rebound from the drum 12 and to come to rest against the hammer backstop pad 32. The increase in voltage at the point of impact 80 is detected by a differentiator circuit 82 shown in FIG. 5. The flight time for the associated hammer assembly 22 is measured by the elapsed time between the firing of the coil 26 and point 80 where the back EMF begins to change direction due to the hammer tip 30 impacting against the drum 12; this flight time is shown between double-headed arrow 81 in FIG. 4. In the embodiment described, the scale along the vertical axis shown in FIG. 4 is 10 volts per division, and along the horizontal axis, the scale is 500 microseconds per division. Naturally, different values may be used for different applications.

Figure 6:
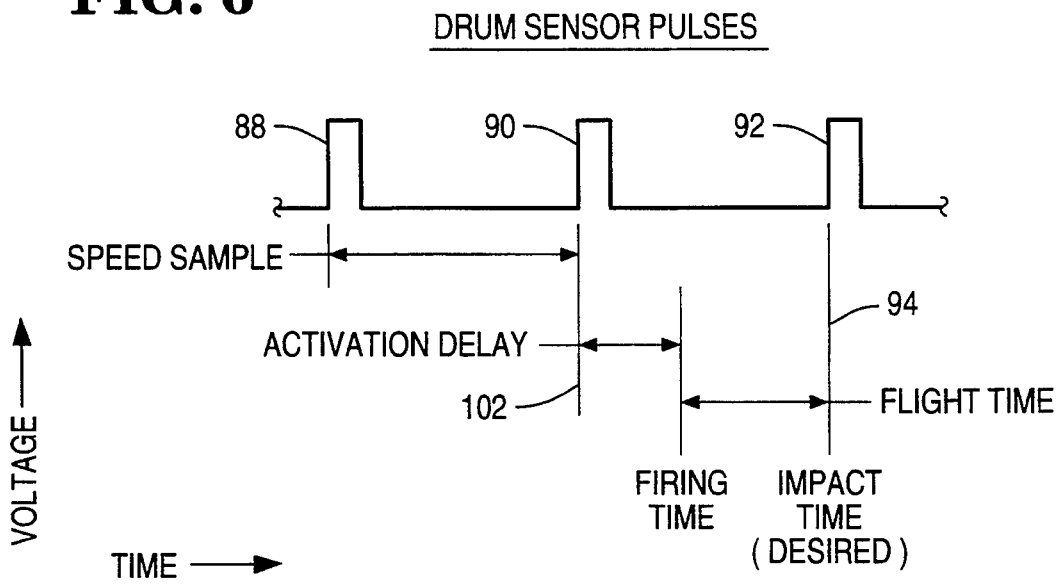
FIG. 6 is a timing diagram associated with the firing of a hammer.

FIG. 6 is a schematic diagram showing how the flight time, which is determined from the process associated with chart shown in FIG. 4, is used in determining when to fire a particular coil 26 for an associated hammer tip 30. This process entails using the conventional drum position sensor 38 (FIG. 3) in association with equally spaced timing marks 84 on the drum 12, with one of the marks, like 86 for example, being a reference or home position mark.

As the drum 12 is rotated by the motor 18 (FIG. 3), the drum position sensor 38 generates the drum sensor pulses shown as 88, 90, and 92, for example. Assume that the flight times for each of the hammer assemblies 22 have been determined from prior operations as previously explained in relation to FIG. 4. From those operations, a predetermined number of the last successive flight times are averaged and stored in a non-volatile RAM associated with the controller 20. There is one such average flight time for each hammer assembly 22 in the printer 10. In the embodiment described, the number of flight times which are averaged and stored is four, although other amounts could be used for different applications.

Assume also that the character to be printed will arrive at the print station 48 via the rotating drum 12 and that the associated hammer tip 30 will impact against the selected character at a time indicated by the vertical line 94 shown in FIG. 6. The operating program OP, which may reside in the ROM 62 or the RAM 64, determines the velocity of the drum 12 just prior to the selected character arriving at the print station 48. In the example being described with regard to FIG. 6, the speed sample is determined by dividing the peripheral distance traveled by the drum 12 by the elapsed time between the leading edges of the pulses 88 and 90. This provides the instantaneous velocity at which the drum 12 is rotating. Because the lines of characters on the drum 12 are equidistantly spaced around the periphery of the drum 12, the elapsed time between the leading edges of the pulses 88 and 90 gives a measure of the velocity of the drum 12. The controller 20 has stored the average flight time for the particular hammer assembly 22 to be "fired" to effect printing of the desired character at the desired character position. By knowing the most recent average flight time for an individual print hammer assembly 22, and by knowing the most recent velocity of the drum 12 (as expressed as a length of time between pulses 88 and 90), an activation delay is determined by subtracting the average flight time from the length of time between the pulses 88 and 90, in the example being described, as shown in FIG. 6.

Figure 5:
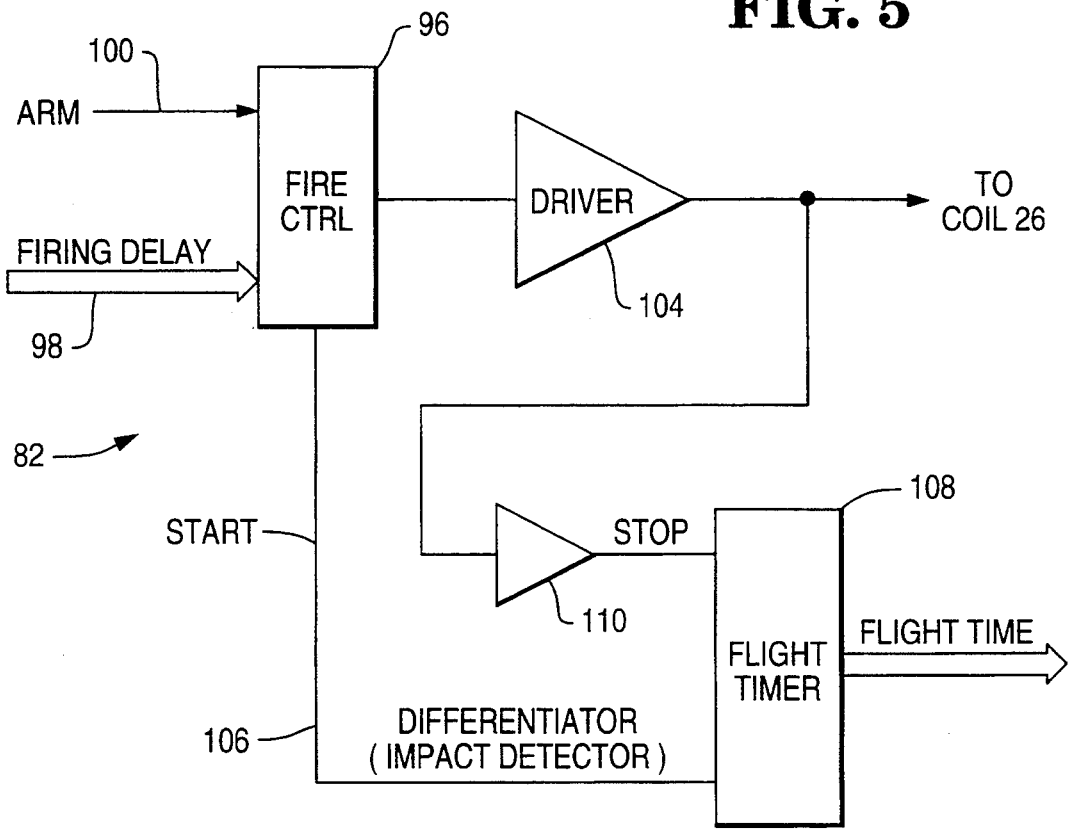
FIG. 5 is a schematic diagram of a circuit for firing hammers associated with the printer shown in FIG. 2.

The actual firing of the coil 26 for the associated hammer assembly 22 to be fired is controlled by the differentiator circuit 82 shown in FIG. 5. As far as controlling the individual characters to be printed, the controller 20, through its associated operating programs OP, controls the selection as is conventionally done. Continuing with the example discussed in the previous paragraph, when the activation delay is determined, it may be expressed as a count which is placed on a down counter, for example, which is referred to as fire control 96 in FIG. 5. The firing delay 98 (FIG. 5) which is expressed as a count corresponds to the activation delay (FIG. 6) which is expressed in time units. The arm signal 100 (FIG. 5) corresponds to the line 102 which (FIG. 6) represents the leading edge of the sensor pulse 90.

Continuing with the discussion associated with the firing of a coil 26 in a hammer assembly 22 as discussed in relation to FIGS. 5 and 6, the arm signal 100 causes the fire control 96 to start down counting. A suitable clock (not shown) is fed into the fire control 96 at the appropriate rate to arrive at the desired activation delay. When the count on the down counter in the fire control 96 reaches zero, an output signal is sent to a driver 104 which energizes the associated coil 26 to cause the hammer tip 30 to advance towards the drum 12. At the same time that the output signal from the fire control 96 is fed to the driver 104, this same signal is fed over line 106 to start a count on an up counter shown as flight timer 108. The output of the driver 104 is monitored by a differentiator circuit or impact detector 110 to detect the current reversal at the point at which the hammer tip 30 impacts against the drum 12 (point 80) as discussed in relation to the chart shown in FIG. 4. The output of the impact detector 110 is used to terminate the count on the flight timer 108 to arrive at a count which reflects the flight time as discussed earlier herein.

Figure 1:
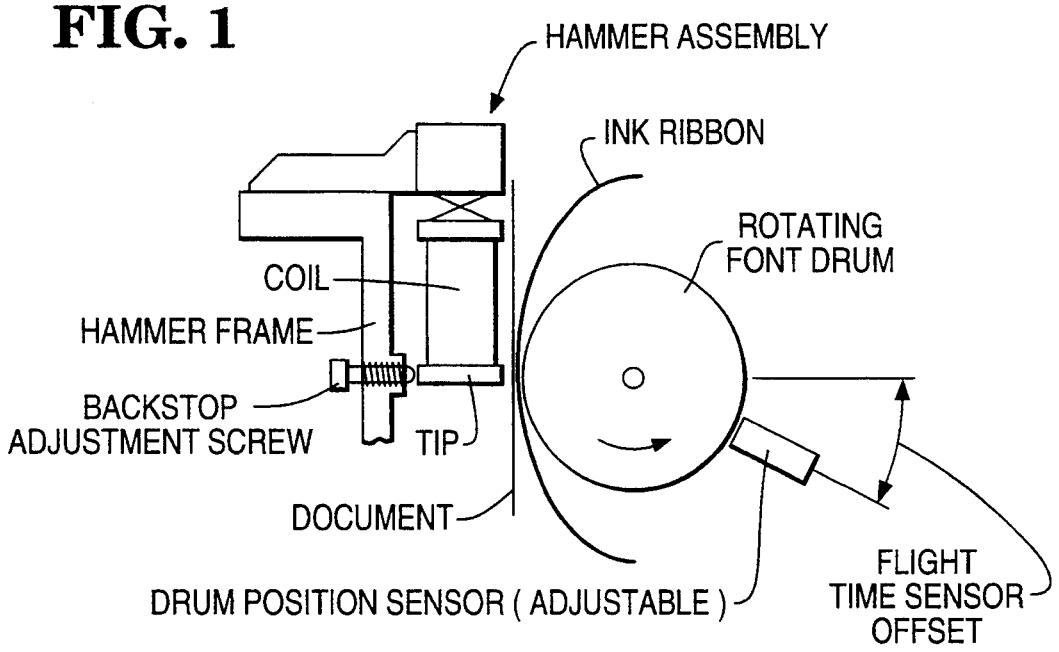
PRIOR ART FIG. 1
FIG. 1 is a schematic diagram showing a prior art drum printer.

There are several features of this invention which should be discussed after the description just given. A differentiator circuit 82 (FIG. 5) is provided for each hammer assembly 22 in the printer 10; this circuit is capable of measuring the actual flight time of the associated hammer assembly 22 to within one microsecond. As previously stated, the operating program OP keeps a running average of the four most recent hammer firings and uses this average flight time to calculate the activation delay or firing delay 98 for each hammer assembly 22 in the printer 10. Another benefit of this technique, is that it removes the need for the position sensor 38 to be offset an amount which is determined by the flight time amount of the associated hammers. In contrast, the position sensor 38 is positioned relative to the drum 12 so that it generates an edge signal, like 88, 90, or 92 shown in FIG. 6, at the moment when each character comes into alignment with the print station 48. The velocity of the rotating drum 12 is calculated just prior to its use in determining the firing delay 98, making control of the hammer firings more accurate than the prior art techniques discussed in relation to FIG. 1. Due to the aging of parts in the printer 10, more precise control of printing is effected by the present invention compared to the prior art shown in FIG. 1. Another feature is that the flight times which are saved for the various hammer assemblies 22, are saved in a non-volatile RAM 64, for example, so that the flight timing data which has been determined does not have to be relearned after a "power on" operation.

The controller 20 keeps track of several elements and activities relative to the printer 10. The controller 20 keeps track of the timing marks 84 on the drum 12 so that it is aware of which character is approaching the print station 48; it does this by the home timing mark 86. The data about the characters may be stored in tables in the RAM 64 in the order in which they appear following the home timing mark 86. As previously described, the controller 20 also keeps a running average of the last four flight times for each hammer assembly 22 in the printer 10.

Another feature of the present invention is that it keeps track of whether or not a particular hammer tip 32 actually "fired" or impacted against the drum 12. The operating program OP records an arm signal 100 and expects the impact 80 to follow in the expected flight time for that particular hammer assembly 22. If the impact 80 does not follow, it indicates that the character has not been printed, This fact could be noted by an indicator or noted on the display 68 and brought to the operator's attention. Print hammer assemblies 22 that fire too early or too late are monitored in this manner to anticipate printing problems. This feature is especially useful when documents, like 34, are being moved in the document track 42 at a rate of 400 documents per minute. When printing on documents in MICR ink (magnetic ink character recognition), the document sensor 46 is used to control an indexing motor (not shown) in the document transport 44 to position the document 34 at the appropriate place to effect printing on the document at a certain distance from the leading edge thereof.

While this invention has been explained in connection with characters on a moveable member which is a rotating drum, the invention could be extended to other printers which employ other moveable members, like a moving band, for example, on which the characters are located.

What is claimed is:

1. A method for electronically adjusting the firing time of a firing coil used to impact a hammer against a selected character in a printer having characters on a moveable member, with the moveable member being positioned to present a selected character at a printing station in the printer, and with the selected character being printed on a document through impacting the hammer against the document and the selected character when the firing coil is electrically energized, said method comprising the steps of:

(a) energizing the coil for the hammer to be fired; and (b) monitoring the back electromotive force (EMF) of the coil as the hammer moves towards the selected character to detect when the back EMF reverses direction as a result of the hammer rebounding from impacting against the selected character;

(c) determining an actual flight time of the hammer by measuring an elapsed time between the energizing of the coil and the time when the back EMF reverses direction;

(d) storing in a memory a last predetermined number of flight times for said hammer;

(e) using an average of the last predetermined number of flight times as the flight time when deciding when to energize the coil for the hammer; and (f) using most recent consecutive outputs from a position sensor relative to timing marks associated with the moveable member to determine a velocity for the moveable member just prior to energizing the coil for the hammer to be fired so as to provide an activation delay prior to energizing the coil, with the velocity being expressed as a length of time between said most recent consecutive outputs, and with the activation delay being determined by subtracting the average flight time from said length of time.

2. The method as claimed in claim 1 in which said steps (a), (b), (c), (d), (e), and (f) are repeated for hammers in addition to said hammer in the printer.

3. The method as claimed in claim 1 in which said printer has an indicator coupled thereto, and said method also includes the step of:

(c) notifying a user of said printer via said indicator that a hammer has not fired when there is no back EMF reversing direction as a result of the hammer rebounding from impacting against the selected character.

4. The method as claimed in claim 1 in which said storing step (d) is effected through (d-1) using a non-volatile RAM so that said average of the last predetermined number of flight times does not have to be relearned after a power on operation of said printer.

5. In a printer, a combination comprising:

a moveable member having a plurality of characters thereon and also having equally spaced timing marks thereon;

a position sensor coacting with said timing marks for generating consecutive outputs, with a velocity for said moveable member expressed as a length of time between two consecutive outputs;

a transport for moving said moveable member at a constant velocity;

a hammer assembly having a hammer and a coil; and a circuit for energizing said coil to enable said hammer to impact against a selected character on said moveable member and for detecting when said back electromotive force (EMF) in said coil reverses direction to give an indication that the hammer has in fact impacted against the selected character;

said circuit including a measuring circuit for measuring a flight time for said hammer starting when said coil is energized and ending when said back EMF in said coil reverses direction, for measuring the velocity of the moveable member by expressing the velocity as a length of time between two most recent consecutive outputs, and for providing an activation delay prior to energizing the coil, with the activation delay being determined by subtracting the average flight time from said length of time between said two most recent consecutive outputs;

said circuit also including:

a controller;

a program for controlling operations of said controller; and a memory;

said controller being effective for determining an average flight time for said hammer depending upon a last predetermined number of flight times for said hammer and for storing said average flight time in said memory for use in a subsequent firing of said hammer.

6. The combination as claimed in claim 5 in which said controller has a display for indicating when the back EMF in said coil has not reversed direction to give an indication that the hammer has not impacted against the selected character.

7. In a printer, a method of electronically adjusting the firing time of an energizing coil used to impact a hammer against a character located on a moveable member carrying characters thereon, said method comprising the steps of:

(a) locating timing marks on the moveable member to correspond to the characters on the moveable member;

(b) locating a position sensor at a location relative to said timing marks so that the position sensor generates a location pulse each time a character on said moveable member is positioned at a print station in said printer;

(c) energizing the coil to impact the hammer against a selected character on the moveable member;

(d) determining a flight time for the hammer by measuring an elapsed time between the energizing of the coil and a time when a back EMF in the energizing current of the coil reverses direction as a result of the hammer impacting against a moveable member;

(e) storing in a non-volatile memory a last predetermined number of flight times for said hammer to obtain a running average flight time;

(f) determining a velocity of the moveable member from an elapsed time between two adjacent timing pulses occurring just prior to the printing of the character to be printed, with the velocity of the moveable member being expressed in units of time;

(g) subtracting the average flight time from the elapsed time from step (f) to arrive at a firing delay starting with the second of said two adjacent timing pulses; and (h) energizing said coil at the termination of said firing delay.

8. The method as claimed in claim 7 in which said method includes the step of:

(i) repeating steps (c) through (h) for subsequent characters to be printed, and in which said energizing step (h) is effected by downcounting a count which represents said firing delay obtained from said subtracting step (g).

9. The method as claimed in claim 8 in which said determining step (d) includes the step of:

(d-1) notifying a user of said printer when the back EMF in the energizing current of the coil does not reverse direction as a result of the hammer impacting against the moveable member, thereby indicating that printing was not effected.

* * * * *